US007275740B2

(12) United States Patent
Able et al.

(10) Patent No.: US 7,275,740 B2
(45) Date of Patent: Oct. 2, 2007

(54) METHOD AND APPARATUS FOR FEEDING SHEETS

(75) Inventors: Douglas Anthony Able, Shelbyille, KY (US); William Thomas Kearney, III, Lexington, KY (US); Thomas Paul Maddux, Lexington, KY (US); Kevin Dean Schoedinger, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 105 days.

(21) Appl. No.: 11/030,030

(22) Filed: Jan. 6, 2005

(65) Prior Publication Data

US 2006/0145409 A1 Jul. 6, 2006

(51) Int. Cl.
*B65H 5/00* (2006.01)

(52) U.S. Cl. ..... 271/10.01; 271/10.02; 271/10.03; 271/110; 271/265.01

(58) Field of Classification Search .. 271/10.01–10.03, 271/10.09, 10.11, 110, 265.01
See application file for complete search history.

(56) References Cited

U.S. PATENT DOCUMENTS 4,551,813 A 11/1985 Sanbayashi et al.
4,804,998 A 2/1989 Miyawaki
5,056,771 A 10/1991 Beck et al.
5,076,567 A 12/1991 Sasaki et al.
5,424,821 A * 6/1995 Sampath ..... 399/45
5,461,468 A 10/1995 Dempsey et al.
5,528,347 A * 6/1996 Kamath et al. ..... 399/18
5,924,686 A * 7/1999 Jacobson et al. ..... 271/3.17
6,076,821 A 6/2000 Embry et al.
6,381,441 B1 4/2002 Byeon et al.
6,421,581 B1 7/2002 Hamamoto et al.
2004/0119224 A1* 6/2004 Otsuka ..... 271/10.03

* cited by examiner

*Primary Examiner*—Patrick Mackey
*Assistant Examiner*—Jeremy R. Severson
(74) *Attorney, Agent, or Firm*—Grossman, Tucker, Perreault & Pfleger PLLC

(57) ABSTRACT

A system, method and article for adjusting the time interval between feeding of successive sheets of media in a printer or copier. The method comprises initiating a first pick signal for a sheet of the media and identifying a feed time for the sheet of media, and identifying an expected feed time for said media. The system compares feed times to an expected feed time and adjusts according to such comparison to substantially correct for slippage or other problems feeding diverse media.

20 Claims, 5 Drawing Sheets

METHOD AND APPARATUS FOR FEEDING SHEETS

FIELD OF INVENTION

The present invention relates to a system, method and article for feeding sheets from a stack of sheets and, more particularly, to a system or method for controlling when each sheet is fed from a stack of sheets by determining a delay between picking the individual sheets based on the measured feed time of the first and subsequent sheets.

BACKGROUND

Faster feeding of the sheets from a stack of sheets will increase the throughput of a printer. Therefore, it is desired to maximize the throughput of a printer by feeding sheets from the stack of sheets at the fastest rate possible. Exemplary of a method and apparatus for feeding sheets from a stack is co-assigned patent application U.S. Pat. No. 6,076,821, entitled "Method and Apparatus for Feeding Sheets," issued to Embry et al., which is incorporated by reference herein.

When feeding sheets from a stack of sheets to a processing station such as a laser printer, for example, it is desired to feed the sheets as quickly as possible without a paper jam. To prevent a paper jam it is useful to prevent the sheets from overlapping. Thus a minimum gap must be maintained between adjacent sheets being fed to prevent the sheets from overlapping while maintaining a desired feed rate.

There are times, however, when paper does jam in the printer for various reasons such as slippage of the feed rollers on the media. The slippage may be caused by use of media with a smoother surface than anticipated. The slippage causes multiple sheets to stop in the paper path. The user must then clear the paper path with risk of damage to the printer or risk pieces of the media remaining in delicate areas of the printer, which may cause future failures. Current algorithms reportedly fail to detect the slippage, particularly of the first sheet picked.

Accordingly there is a need to prevent the jamming of multiple sheets of media by detecting slippage of the feed rollers on the media and, more particularly, detecting slippage of the feed rollers on the first sheet of media. Therefore a more robust adaptive pick algorithm is necessary.

It is thus an object of the present invention to provide a more robust adaptive pick algorithm that detects slippage and, in particular, slippage of the first sheet.

It is a further object of the present invention to provide a control algorithm for controlling the feed rate so as to prevent jamming multiple sheets of media in the paper path due to feed problems.

It is a further object of the present invention to provide a method to adjust feeding a selected type of media or a method that may be applied to a number of media types.

It is still a further object of the present invention to adjust the delay between feeding the individual sheets based on the feeding time of the previous sheet and, more particularly, the first sheet.

SUMMARY

In one embodiment, the present invention relates to a method for adjusting the time interval between feeding of successive sheets of media in a printer or copier comprising providing a media stack containing sheets of media; initiating a first pick signal for a sheet of said media and identifying a feed time for said sheet of media, identifying a maximum feed time and an expected feed time for said sheet of media; identifying whether or not said sheet of media is a first sheet of media; and identifying whether or not said first sheet of media is problem media.

In another embodiment, the present invention relates to a system for determining when each sheet in a stack of sheets is fed from the stack comprising a processor capable of initiating a first pick signal for a sheet of media and identifying a feed time for said sheet of media, the processor capable of identifying a maximum feed time and an expected feed time for said sheet of media; wherein the processor is capable of identifying whether or not said sheet is a first sheet and whether or not said first sheet is problem media.

In another embodiment the present invention relates to an article comprising a storage medium having stored thereon instructions that when executed by a machine result in the following operations: sending a first pick signal for a sheet of said media and identifying a feed time for said sheet of media; identifying a maximum feed time and an expected feed time for said sheet of media; identifying whether or not said sheet of media is a first sheet of media and identifying whether or not said first sheet is problem media.

DETAILED DESCRIPTION OF PREFERRED EMBODIMENT

The present invention relates to a system, method and article for feeding sheets from a stack of sheets and, more particularly, to a system or method for controlling when each sheet is fed from a stack of sheets by determining a delay between picking the individual sheets based on the measured feed time of the first and subsequent sheets. The present invention is particularly directed to the feeding of media that has a tendency to slip and thereby cause multiple sheets to jam in the paper feed path.

Figure 1:
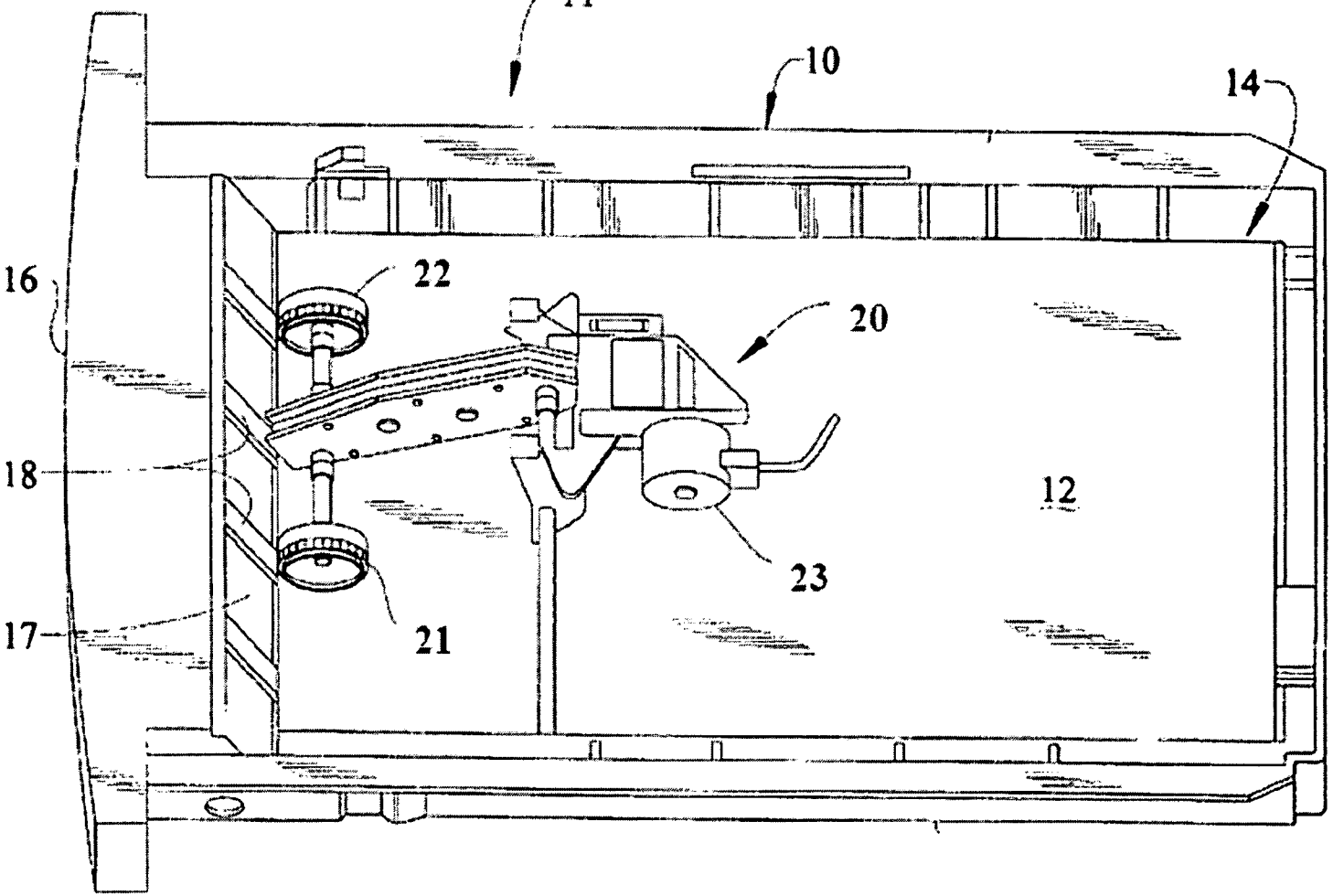
FIG. 1 is a top plan view of a sheet support tray of the present invention having a stack of sheets of media therein for advancement by an auto-compensating pick mechanism.
Figure 2:
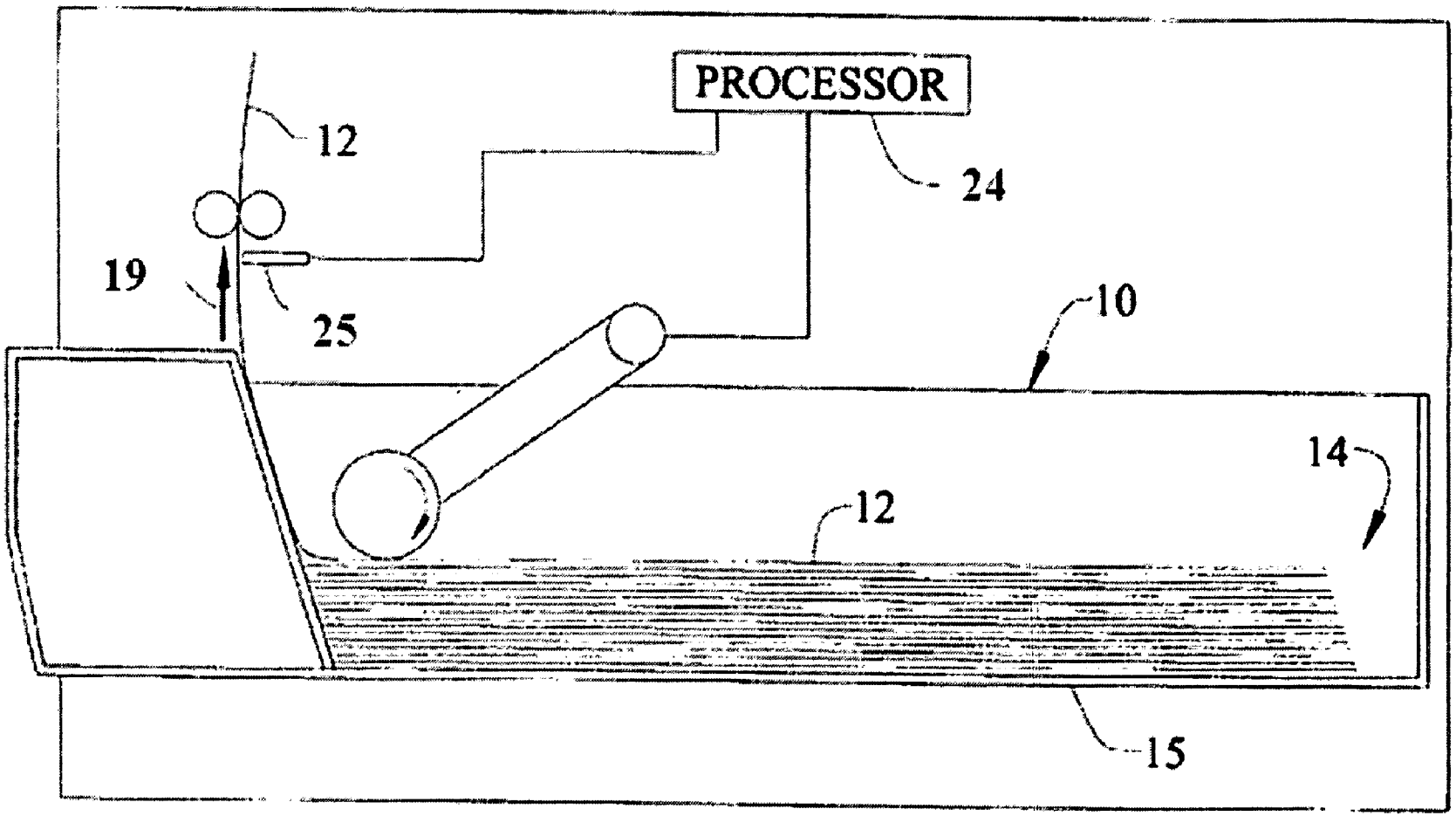
FIG. 2 is a schematic view showing the relation between the floating pick arm of the auto compensating pick mechanism, a stack of sheets of media in a tray, a sensor and a microprocessor.

FIGS. 1 and 2 illustrate a sheet support tray of the present invention having a stack of sheets therein for advancement by an auto-compensating pick mechanism as disclosed in U.S. Pat. No. 6,076,821. A tray 10, which may be located inside of a printer 11, for example, is used to support sheets of media 12, such as, but not limited to, paper, card stock, film, such as transparencies, or printer labels, in a stack 14.

At the front end 16 of the tray 10, there is an inclined wall 17, inclined at an obtuse angle from a bottom wall 15 (see FIG. 2.) On the inclined wall 17 is a number of ribs 18 on which the sheet stack 14 may be engaged. A sheet 12 is advanced along the inclined wall 17 and ribs 18 through a predetermined feed path 19 and into a processing station, (not illustrated,) of the printer 11 where the media is printed.

An auto-compensating pick mechanism 20 is used to advance the sheets 12 from the tray 10. The auto-compensating pick mechanism 20 is similar to the type described in Padget et al., U.S. Pat. No. 5,527,026, incorporated by reference herein. The auto-compensating pick mechanism 20 includes a pair of feed rollers 21 and 22, which are driven from a motor 23 through a gear train, (not illustrated). The motor 23 is alternately turned off and on by a microprocessor 24 as each of the sheets 12 is advanced from the top of the stack 14 of the sheets.

Figure 3:
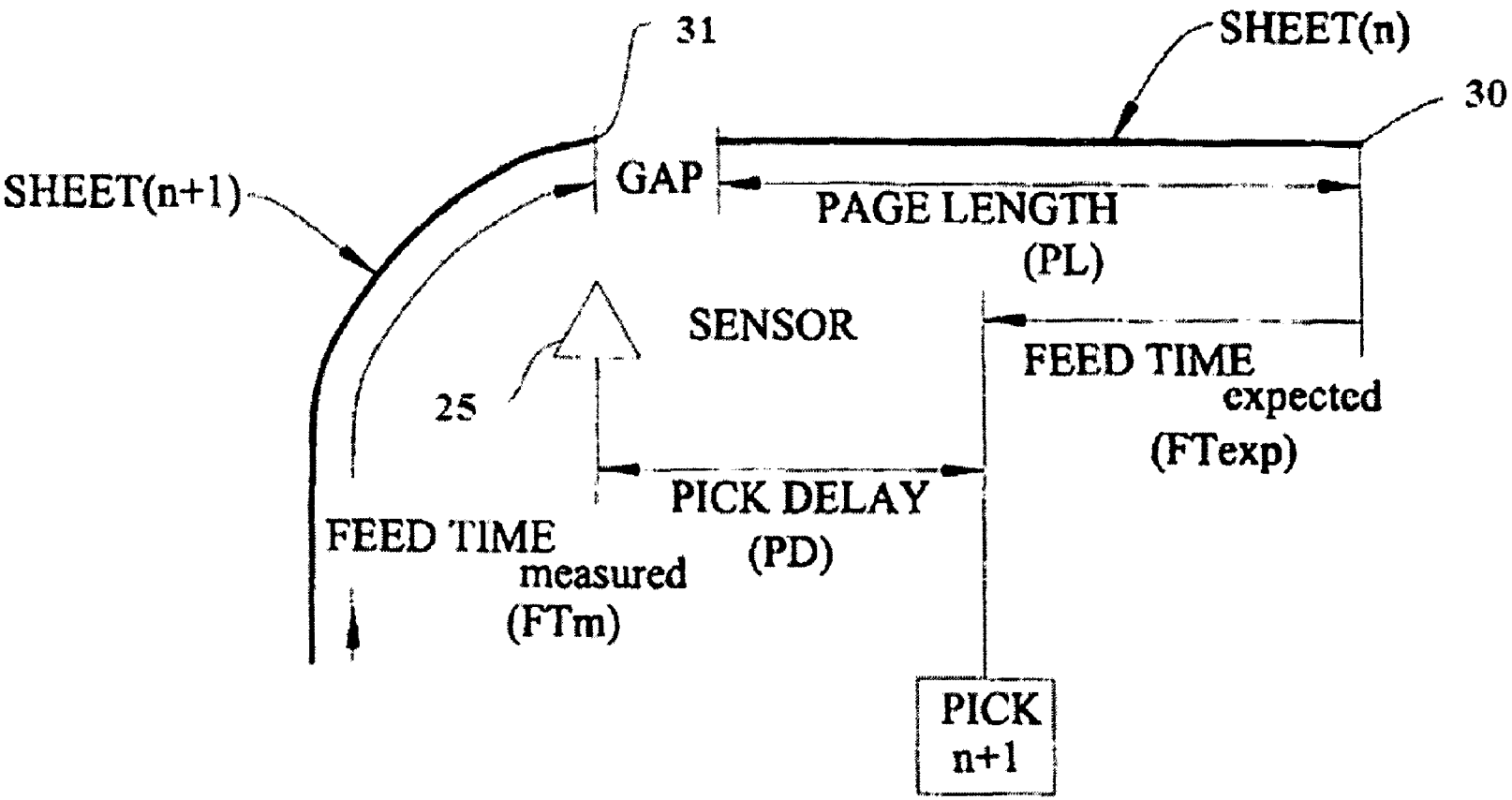
FIG. 3 is a timing diagram showing the relation between the fed sheets.

Referring to FIG. 3, in order to feed the sheets properly, a gap may be maintained between the sheet(n) and sheet(n+1) to prevent the sheets from jamming. However, it is advantageous to keep this gap as small as possible to minimize the amount of time required between feeding individual sheets and to maintain a desired throughput; further described in U.S. Pat. No. 5,056,771, issued to Beck et al., and incorporated by reference herein. Therefore, a particular amount of time is necessary to feed a full sheet length through the predetermined feed path and maintain a targeted gap between the sheets. This amount of time is represented in FIG. 3 as PL, (sheet length), and GAP, (Gap targeted, or $G_t$ as used in the following equations).

In an embodiment of the invention, it is first useful to point out that the time necessary to feed a full sheet length (PL) and maintain a desired gap (GAP) is determined by measuring the time between the microprocessor (not illustrated) sending a pick signal to begin the sheet feeding process and the microprocessor receiving a signal from a sensor 25 that detects the leading edge of a sheet 30. It can be appreciated that, since the distance of the predetermined paper path 19 (see FIG. 2) and other constants are known, these calculations may also be accomplished in terms of the time relationship to these known constants, such as speed.

The expected feed time ($FT_{exp}$) is the amount of time believed necessary for the leading edge 30 of a sheet(n) to trigger sensor 25 after the picking process has been initiated by the pick signal. The time between the leading edge 30 of the sheet n and the leading edge 31 of the sheet n+1 is defined in accordance with this invention by a pick delay time (PD) plus an expected feed time ($FT_{exp}$). This relationship may be represented by the following equation:

$$PD+FT_{exp}=PL+G_t.$$

Thus, solving for PD, the pick delay may be determined by the following equation:

$$PD=PL+G_t-FT_{exp}.$$

Typically, the expected feed time and pick delay are predetermined and supplied to the microprocessor. For the first sheet n, where n=1, an initial feed time, $FT_i$, is supplied. In the case of subsequent sheets, sheets picked after the first sheet n+1, the expected feed time, $FT_{exp}$, is based on the measured feed time, $FT_m$, of the previous sheet n. There are cases in which the first sheet, for example, does not feed as expected due to unspecified or unknown media properties. For example, the feed rollers may slip on the media due to the surface texture and coefficient of friction. As the feed time increases subsequent media that does not slip can overlap and become jammed or stop.

Furthermore, there is a ceiling or a maximum feed time, $FT_{max}$ supplied to the microprocessor. The value of the maximum feed time represents the feed time for a typical last sheet in a stack to reach the sensor after picking. This value is also supplied to the microprocessor.

The present invention addresses this and other problems by adjusting the pick delay (PD) according to the performance of the previous sheet n and in particular, the first sheet, where n=1. The method may be applied to a particular mode setting, in which a specific type of media is selected, or for all mode settings regardless of the media selected.

Figure 4:
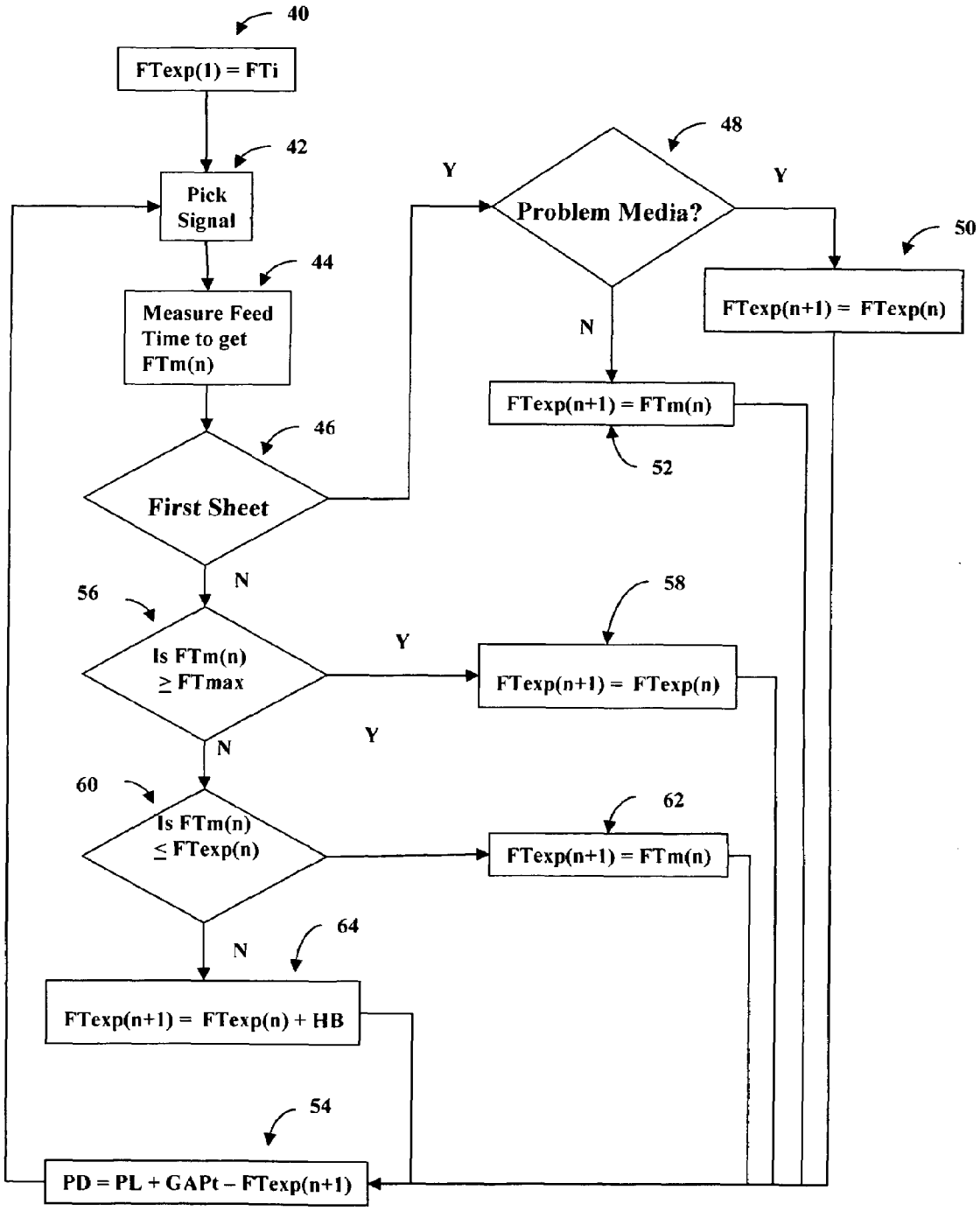
FIG. 4 is a flow chart of how the time of picking each sheet is determined.

FIG. 4 is a schematic diagram of a preferred embodiment of the present invention. An initial feed time, $FT_i$ is supplied to the microprocessor and at 40 set equal to the expected feed time for the first sheet n, i.e. $FT_{exp(n=1)}$. The $FT_i$ may assume a full tray and a fast pick. The microprocessor issues a pick signal 42 to initiate the picking process and initiates a timer or utilizes a built in clocking mechanism. This causes the auto-compensation pick mechanism to begin the advance of a sheet of media. The leading edge of sheet n passes in front of the sensor thereby sending a "stop-time" signal to the microprocessor which stops the timing mechanism.

At 44 the amount of time measured between the pick signal and the "stop-time" signal is the measured feed time, $FT_{m(n)}$. A determination is then made at 46 whether the sheet n, is the first sheet fed through the system. A sheet may be considered the first sheet when it is, e.g., the first sheet fed after a power-on condition, after a tray has been removed from its position and returned thereto, or after the motor stops.

If the sheet is identified as the first sheet at decision point 46, it is then determined at 48 whether the media is problem media, which would amount to media that slips or has other associated feeding difficulties. The determination of whether media is problem media at point 48 may be associated to a number of conditions. In one embodiment, problem media may be associated with a specific media input setting that is selected by the user via, e.g., a printer-user interface. In another embodiment, problem media may be associated with a determination that the measured feed time, $FT_m$, of sheet n is greater than the maximum feed time, $FT_{max}$, where $FT_m>FT_{max}$.

If the media is determined to be problem media at decision point 48, then at 50 the feed time expected for the next sheet n+1, $FT_{exp(n+1)}$, is set to an expected feed time for sheet n, $FT_{exp(n)}$, where $FT_{exp(n+1)}=FT_{exp(n)}$. It should be appreciated that effectively, the measured feed time of the sheet is ignored. In such case the expected feed time for the next sheet n+1, $FT_{exp(n+1)}$, is then used at 54 to determine the pick delay of the successive sheet n+1, $PD=PL+G_t-FT_{exp(n+1)}$. Notice that in this situation, the pick delay is not changed regardless of whatever value may exist for the measured feed time.

If the media is not determined to be problem media at 48, then at 52 the feed time expected for the next sheet n+1, $FT_{exp(n+1)}$, is set to the measured feed time of the sheet n, $FT_{m(n)}$, where $FT_{exp(n+1)}=FT_{m(n)}$. The expected feed time for the next sheet n+1, $FT_{exp(n+1)}$, is then used at 54 to determine the pick delay of the successive sheet n+1, $PD=PL+G_t-FT_{exp(n+1)}$.

Returning to 46, if the sheet n is identified as not being the first sheet, at 56 the feed time measured, $FT_{m(n)}$, is compared to the maximum feed time, $FT_{max}$. A determination is then made as to whether the feed time measured $FT_{m(n)}$ is greater than, or equal to, the feed time max $FT_{max}$, where $FT_{m(n)} \geqq FT_{max}$. If the feed time measured is greater than, or equal to, the feed time max then at 58 the feed time expected for the next sheet n+1, $FT_{exp(n+1)}$, is set equal to the feed time expected, $FT_{exp}$, determined by the previous sheet, where $FT_{exp(n+1)}=FT_{exp}$. The expected feed time for the next sheet n+1, $FT_{exp(n+1)}$, is then used at 54 to determine the pick delay of the successive sheet n+1, $PD=PL+G_t-FT_{exp(n+1)}$.

However, if the feed time measured is not greater than or equal to the feed time max, then a determination is made at 60 as to whether the feed time measured, $FT_{m(n)}$, is less than, or equal to, the expected feed time, $FT_{exp(n)}$, where $FT_{m(n)} \leqq FT_{exp(n)}$. If the measured feed time, $FT_{m(n)}$, is less than, or equal to, the expected feed time, $FT_{exp(n)}$, then the feed time expected for the next sheet n+1, $FT_{exp(n+1)}$, is set equal at 62 to the measured feed time, $FT_{m(n)}$, where, $FT_{exp(n+1)}=FT_{m(n)}$. The expected feed time for the next sheet n+1, $FT_{exp(n+1)}$, is then used at 54 to determine the pick delay of the successive sheet n+1, $PD=PL+G_t-FT_{exp(n+1)}$.

In the alternative, if the sheet n is not identified as the first sheet at 46, is not greater than or equal to the max feed time at 56, and is not less than or equal to the expected feed time at 60, then at 64 the expected feed time for the next sheet n+1, $FT_{exp(n+1)}$, is set equal to the feed time expected, $FT_{exp(n)}$, plus an additional increment of time, HB; thus, $FT_{exp(n+1)}=FT_{exp(n)}+HB$. In a preferred embodiment, the increment of time may be measured in constant increments of 10 milliseconds. However various other time increments or time measurements may be used as well, including encoder pulses. Then the expected feed time for the next sheet n+1, $FT_{exp(n+1)}$, is used at 54 to determine the pick delay of the successive sheet n+1, $PD=PL+G_t-FT_{exp(n+1)}$.

In a preferred embodiment, the process is applied to subsequent sheets, n+1, n+2, etc., to obtain an optimum feeding rate, in which the expected feed time is based upon the measured feed time of the previous sheet, as illustrated at 56, 60 and 64.

It should be understood that the use of n, n+1, . . . , etc. in association with feed time variables is to explain how the software functions. Thus, each of the n, n+1, . . . , etc. will increase by one in the examples described herein for each of the sheets being fed thereafter.

Alternatively, it can be appreciated that in the context of the invention, one could also vary gap time to accommodate that situation where the measured feed time varies from the expected feed time, so that the system may again adjust for slippage. Thus, in the context of the present invention, for a given page length, one may adjust gap time, pick delay, and expected feed time, as may be necessary, depending upon whether or not the measured feed time varies with respect to an expected feed time.

Figure 5:
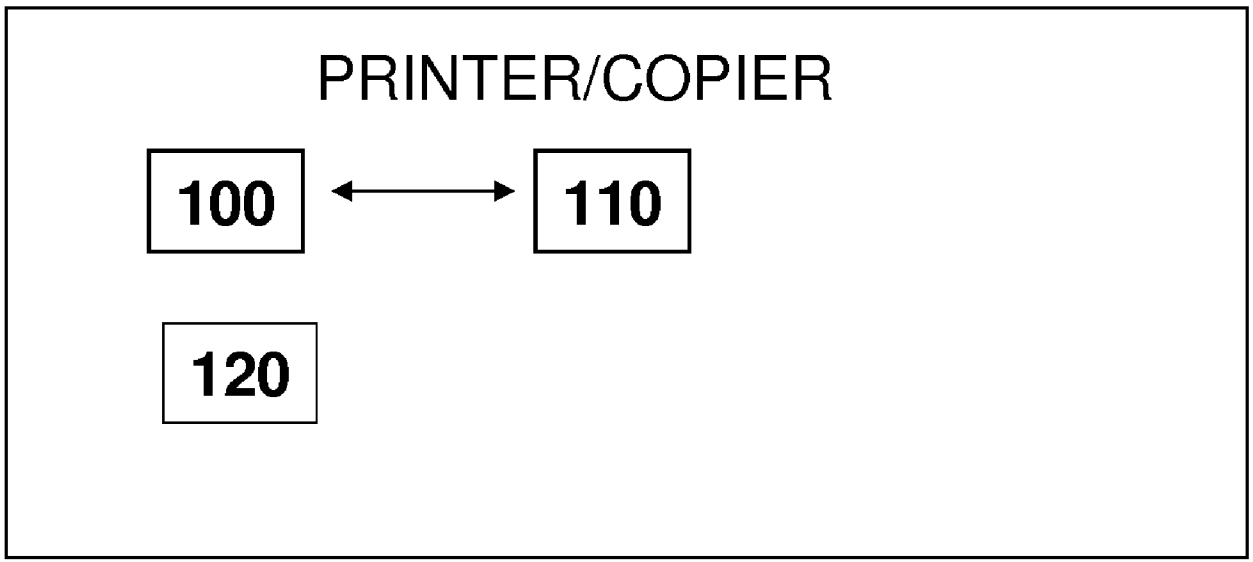
FIG. 5 illustrates a basic systems level diagram of the present invention.

In addition, it should be noted that all of the foregoing control actions and computations may be accomplished by an electronic data processor, which typically is a microprocessor (or microprocessors). It should also be appreciated that the functionality described herein for the embodiments of the present invention may be implemented by using hardware, software, or a combination of hardware and software, either within the printer or copier or outside the printer copier, as desired. If implemented by software, a processor and a machine readable medium may be required. The processor may be of any type of processor capable of providing the speed and functionality required by the embodiments of the invention. Machine-readable memory include any media capable of storing instructions adapted to be executed by a processor. Some examples of such memory include, but are not limited to, read-only memory (ROM), random-access memory (RAM), programmable ROM (PROM), erasable programmable ROM (EPROM), electronically erasable programmable ROM (EEPROM), dynamic RAM (DRAM), magnetic disk (e.g., floppy disk and hard drive), optical disk (e.g. CD-ROM), and any other device that can store digital information. The instructions may be stored on medium in either a compressed and/or encrypted format. Accordingly, in the broad context of the present invention, and with attention to FIG. 5, the printer or copier may contain a processor 100 and machine readable media 110 and user interface 120.

The foregoing description is provided to illustrate and explain the present invention. However, the description hereinabove should not be considered to limit the scope of the invention set forth in the claims appended here to.

What is claimed is:

1. A method for adjusting the time interval between feeding of successive sheets of media in a printer or copier comprising:

initiating a first pick signal for a sheet of media and identifying a measured feed time for said sheet of media;

identifying a maximum feed time and a first expected feed time for said sheet of media;

identifying whether or not said sheet of media is a first sheet of media; and identifying whether or not said first sheet of media is problem media by identifying if said measured feed time of said first sheet of media is greater than said maximum feed time, wherein if said measured feed time is greater than said maximum feed time, set a second expected feed time for a subsequent sheet to said first expected feed time for said first sheet of media and if said measured feed time of said first sheet of media is not greater than said maximum feed time, set said second expected feed time for said subsequent sheet to said measured feed time for said first sheet of media.

2. The method of claim 1 further including, when said sheet is not identified as said first sheet:

identifying whether or not said measured feed time is greater than or equal to said maximum feed time; and identifying whether or not said measured feed time is less than or equal to said expected feed time.

3. The method of claim 1 wherein identifying whether said first sheet is problem media further comprises identifying a user selected parameter.

4. The method of claim 1 further comprising:

feeding said subsequent sheet according to said first expected feed time if said first sheet is problem media; and feeding said subsequent sheet according to said measured feed time if said first sheet is not problem media.

5. The method of claim 2 further comprising identifying that said sheet of media is not a first sheet and:

feeding said successive sheets according to said expected feed time if said measured feed time is greater than or equal to said maximum feed time;

feeding said successive sheets according to said measured feed time if said measured feed time is equal to or less than said expected feed time; and feeding successive sheets according to said expected feed time plus an additional value wherein said measured feed time is not identified greater than or equal to said maximum feed time and is not identified as less than or equal to said expected feed time.

6. The method of claim 1 wherein said media stack comprises sheets of printable media.

7. The method of claim 6 wherein said printable media is selected from the group consisting of paper, cardstock, labels or film.

8. A system for determining when each sheet in a stack of sheets is fed from the stack comprising:

a processor capable of initiating a first pick signal for a sheet of media and identifying a measured feed time for said sheet of media; wherein said processor is capable of identifying a maximum feed time and a first expected feed time for said sheet of media; and said processor is capable of identifying whether or not said sheet is a first sheet and is capable of identifying whether or not said first sheet is problem media by identifying if said measured feed time of said first sheet of media is greater than said maximum feed time, wherein if said measured feed time of said first sheet of media is identified as greater than said maximum feed time, said processor is capable of setting a second expected feed time for a subsequent sheet to said first expected feed time for said first sheet of media and if said measured feed time of said first sheet of media is not identified as greater than said maximum feed time, said processor is capable of setting said second expected feed time for said subsequent sheet to said measured feed time for said first sheet of media.

9. The system of claim 8 wherein said first sheet is not identified as first sheet, said processor is capable of identifying whether or not said measured feed time is greater than or equal to said maximum time; and said processor is capable of identifying whether or not said measured feed time is less than or equal to said expected feed time.

10. The system of claim 8 wherein said processor is further capable of identifying problem media by identifying a user selected parameter.

11. The system of claim 9 wherein said processor that is capable of identifying whether or not said sheet of media is a first sheet is capable of:

feeding successive sheets of media according to said expected feed time if said processor identifies said measured feed time as being greater than or equal to said maximum feed time;

feeding successive sheets of media according to said measured feed time if said processor identifies said measured feed time as being less than or equal to said expected feed time; and feeding successive sheets of media according to said measured feed time plus an additional value if said measured feed time is not identified as greater than or equal to said maximum feed time and not identified as less than or equal to said expected feed time.

12. The system of claim 8 further comprising a picking device capable of communicating with said processor to receive said first pick signal.

13. The system of claim 8 further comprising a sensor capable of communication with said processor capable of communicating a signal to said processor to identify said measured feed time for said sheet of media.

14. The system of claim 8 wherein said sheet of media and said successive sheets of media are arranged in a stack.

15. The system of claim 14 wherein said sheet of media and said successive sheets of media are selected from the group consisting of paper, cardstock, labels, and film.

16. An article comprising:

a storage medium having stored thereon instructions that when executed by a machine result in the following operations:

sending a first pick signal for a sheet of said media and identifying a measured feed time for said sheet of media;

identifying a maximum feed time and a first expected feed time for said sheet of media; and identifying whether or not said sheet of media is a first sheet of media and identifying whether or not said first sheet is problem media by identifying if said measured feed time of said first sheet of media is greater than said maximum feed time, wherein if said measured feed time is greater than said maximum feed time, a second expected feed time for a subsequent sheet is set to said first expected feed time for said first sheet of media and if said measured feed time of said first sheet of media is not greater than said maximum feed time, said second expected feed time for said subsequent sheet is set to said measured feed time for said first sheet of media.

17. The article of claim 16, wherein said instructions that when executed by said machine result in the following additional operations when said sheet is not identified as a first sheet:

identifying whether or not said measured feed time is greater than or equal to said maximum feed time; and identifying whether or not said measured feed time is less than or equal to said expected feed time.

18. The article of claim 16, wherein said instructions that when executed by said machine result in the following additional operations:

identifying whether or not said first sheet is problem media by further identifying a user selected parameter.

19. The article of claim 16, wherein said instructions that when executed by said machine result in the following additional operations:

initiating a subsequent pick signal determined by said first expected feed time if said first sheet is identified as problem media; and initiating a subsequent pick signal determined by said measured feed time if said first sheet is not identified as problem media.

20. The article of claim 17, wherein said instructions that when executed by said machine result in the following additional operations when identifying that a sheet of media is not identified as a first sheet of media:

initiating a subsequent pick signal determined by said expected feed time if said measured feed time is greater than or equal to said maximum feed time;

initiating a subsequent pick signal determined by said measured feed time if said measured feed time is less than or equal to said expected feed time; and initiating a subsequent pick signal determined by said expected feed time plus an increment if said measured feed time is not greater than or equal to said maximum feed time and if said measured feed time is not less than or equal to said expected feed time.

* * * * *